United States Patent [19]

Hector

[11] Patent Number: 5,047,750

[45] Date of Patent: Sep. 10, 1991

[54] NON-INTRUSIVE INFANT SECURITY SYSTEM

[76] Inventor: Larry F. Hector, 303 W. North St., Hinsdale, Ill. 60521

[21] Appl. No.: 491,105

[22] Filed: Mar. 9, 1990

[51] Int. Cl.[5] ..... G08B 23/00

[52] U.S. Cl. ..... 340/573; 340/572

[58] Field of Search ..... 340/573, 572, 551, 539, 340/571; 455/100

[56] References Cited

U.S. PATENT DOCUMENTS

| | | | |
|---|---|---|---|
| 3,696,379 | 10/1972 | Minasy | 340/280 |
| 3,777,086 | 12/1973 | Riedo | 340/573 X |
| 4,136,338 | 1/1979 | Antenore | 340/551 |
| 4,336,531 | 6/1982 | Kincaid | 340/568 |
| 4,471,343 | 9/1984 | Lemelson | 340/571 |
| 4,536,755 | 8/1985 | Holzgang et al. | 340/573 |
| 4,539,559 | 9/1985 | Kelly et al. | 340/573 |
| 4,539,560 | 9/1985 | Fleck et al. | 340/573 |
| 4,555,696 | 11/1985 | Brown | 340/551 |
| 4,682,155 | 7/1987 | Shirley | 340/573 |
| 4,684,933 | 8/1987 | Dill | 340/573 X |
| 4,694,284 | 9/1987 | Leveille et al. | 340/574 |
| 4,700,180 | 10/1987 | Vance | 340/573 |
| 4,733,633 | 3/1988 | Yarnall, Sr. et al. | 119/29 |
| 4,736,312 | 4/1988 | Dassler et al. | 455/100 X |
| 4,745,882 | 5/1988 | Yarnall, Sr. et al. | 119/29 |
| 4,753,692 | 8/1988 | Wolk et al. | 340/573 |
| 4,766,847 | 8/1988 | Venczel et al. | 119/29 |
| 4,768,023 | 8/1988 | Xie | 340/573 |
| 4,774,504 | 9/1988 | Hartings | 340/572 |
| 4,777,477 | 10/1988 | Watson | 340/573 |
| 4,777,478 | 10/1988 | Hirsch et al. | 340/573 |
| 4,780,706 | 10/1988 | Bollag | 340/666 |
| 4,785,291 | 11/1988 | Hawthorne | 340/573 |
| 4,796,014 | 1/1989 | Chia | 340/573 |
| 4,800,369 | 1/1989 | Gomi et al. | 340/572 |
| 4,812,811 | 3/1989 | Asbrink et al. | 340/571 |
| 4,814,751 | 3/1989 | Hawkins et al. | 340/573 |
| 4,870,700 | 9/1989 | Ormanns et al. | 455/100 X |
| 4,899,134 | 2/1990 | Wheeless, Jr. | 340/573 |

*Primary Examiner*—Glen R. Swann,III
*Assistant Examiner*—Thomas J. Mullen, Jr.
*Attorney, Agent, or Firm*—Patula & Associates

[57] ABSTRACT

A security system for infants having a tuned fixed frequency coil affixed to an infant's diaper. A detector for detecting when the tuned coil is in physical proximity or the absence of physical proximity to the detector. An alarm system is in communication with the detector to indicate when the coil is detected by the change in proximity of the infant by the monitoring of the location of the coil.

21 Claims, 2 Drawing Sheets

NON-INTRUSIVE INFANT SECURITY SYSTEM

This invention relates to an economical security system which guards against and alerts of the unpermitted removal of an infant from an area by application of a sensor on the infant's diaper.

BACKGROUND OF THE INVENTION

The potential for the abduction of infants from hospitals is a valid concern of all involved: the parents, the hospital, and the public. There is a need to provide a simple, cost effective and safe means which seeks to remedy this specific threat.

In the past, "tracking systems" were developed to locate a missing person or animal and/or which proposes an alarm system which sounds with egress, such as in U.S. Pat. Nos. 4,814,751 to Hawkins; 4,136,338 to Antenore; U.S. Pat. No. 4,694,284 to Leveille et al. However, these disclosures are dissimilar to the present invention in that the present invention employs a simple economical circuit device clandestinely placed on the infant's diaper while the others consist of highly visible and complex radio, antenna, and electrical systems. Furthermore, the complexity of these various systems is prohibitive for disposable use situations and for large scale, economical applications. Most importantly, in use, these prior systems are easily discovered by an abductor or kidnapper of the infant and defeated. No known device or system utilizes an innocuously placed sensor on an infant's diaper or even on children and adults wearing apparel to guard against abduction from within a controlled area.

Other known devices which are attached to an infant's diaper are solely for the purpose of detecting wetness by the soiling of an infant's diaper. Baidson, U.S. Pat. No. 3,508,235; Chia, U.S. Pat. No. 4,796,014; and U.S. Pat. No. 4,768,023 to Xie. The purpose of such devices is to detect the fact that the infant has soiled his diaper and not whether the child has been abducted.

The devices of the type shown in Hartings, U.S. Pat. No. 4,774,504 and Gomi, U.S. Pat. No. 4,800,369 are anti-theft devices, such as those used by department stores to discourage shoplifting. However, these disclosures are dissimilar from the present invention because first, such systems serve an entirely different function in protecting intangible goods over human infants, second, they utilize different mechanical devices and tend to contain highly complex circuitry, thirdly, they do not purposely tend to hide or conceal the sensor on the infant and, fourthly, they are not suitable for use in a non-intrusive manner with newborns or infants.

Pressure mats or switches as shown in FIGS. 3-4 of U.S. Pat. No. 4,780,706 to Bollag or U.S. Pat. No. 4,700,180 to Vance are not feasible because the system would have to be deactivated for each newborn or infant when held by his parent, care giver or to be examined by a physician. The present invention allows the infant to be held, fed, comforted and temporarily moved for medical tests, bathing etc. within the guarded confines of a nursery or hospital.

The human limb mounted band or collar configured sensor or transmitters shown in the prior art as in U.S. Pat. No. 4,777,477 to Watson or U.S. Pat. No. 4,536,755 to Holzgang et al. are not appropriate for a newborn or an infant. Such devices would interfere with the newborn's health, be visible to the would-be kidnapper and would provoke health concerns of the newborn from the parents, physicians and nurses.

All other known devices are for monitoring or detecting pets, humans, or shoplifted goods, but do not provide or intend to keep the sensor hidden, still be non-intrusive to the wearer and yet be easy to implement, disposable and economical. While the foregoing references may be tangentially relevant to the present invention, it is clear that none of the prior art, taken singularly or in combination, teaches, hints or suggests the very economical and dependable system taught by this invention.

Briefly, the present invention comprises a system of notifying personnel of an unauthorized removal of an infant from a hospital or similar setting. Past incidents demonstrate that infant abduction from hospitals is a genuine threat. This poses major liability concerns for hospitals and day-care centers. Parents are naturally concerned for the utmost security of their infant and the public seeks to prevent such potential tragedies.

This invention can allay these fears by providing a reliable and economical system for detecting an unauthorized, attempted abduction of an infant or child. Another benefit of this invention is that, unlike other detector devices which are in direct contact with an individual, the sensor device in this invention is applied to a diaper and not directly to the infant's person. This eliminates any potential for self-harm by the infant or the health concerns of placing foreign objects near to or on a newborn or an infant. The invention system is equally applicable to use with children, adults and the elderly. The sensor or tuned circuits of this invention are intended to be passive and without their own power sources contained within the sensors or on the wearer.

SUMMARY OF THE INVENTION

The system consists of a simple tuned coil sensor or a passive resonant circuit and a detector or sensor monitor having an alarm system. The sensor is either housed in an adhesive coated pouch constructed of a material and color similar to a disposable diaper or affixed to a flat adhesively coated backing also selected to appear to match or blend in with the diaper material. The sensor is virtually undetectable once applied in an innocuous position on the diaper. The sensor may be disposed of along with a soiled diaper.

When an infant wearing the sensor on his or her diaper passes through an exit guarded by the monitors, an audio and/or visual alarm is triggered. An annunciator may indicate which exit has been activated to alert security personnel. The system's detector monitor is reset automatically a short time after being triggered or may be reset manually.

Numerous other advantages and features of the invention will become readily apparent from the detailed description of the preferred embodiment of the invention, from the claims, and from the accompanying drawings, in which like numerals are employed to designate like parts throughout the same.

BRIEF DESCRIPTION OF THE DRAWING FIGURES

BRIEF DESCRIPTION OF THE PREFERRED EMBODIMENT

Figure 1:
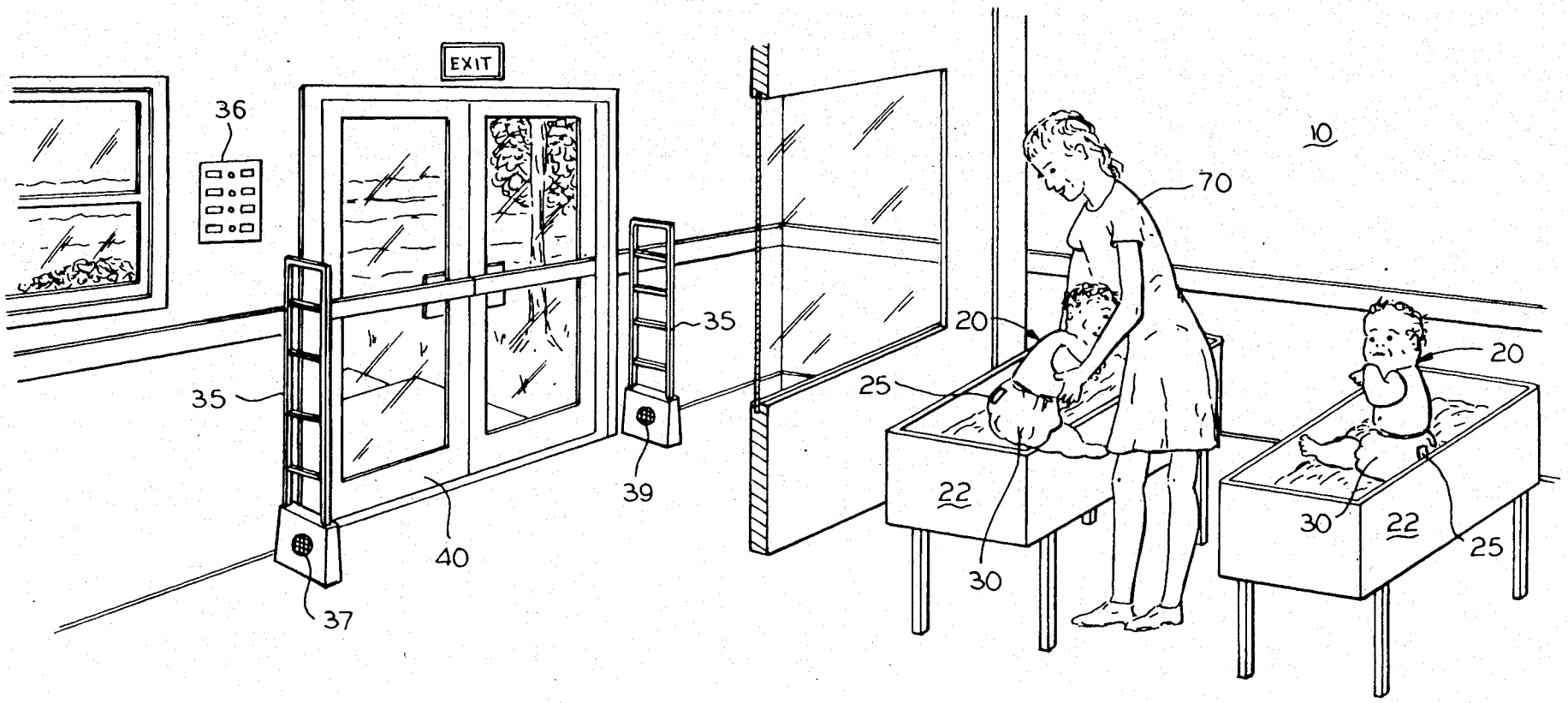
FIG. 1 is a perspective view of a typical hospital nursery environment with infants depicted with the system of the present invention.

While the invention is susceptible of embodiment in many different forms there is shown in the drawings and will be described herein in detail, a preferred and alternate embodiment of the invention. It should be understood, however, that the present disclosure is to be considered an exemplification of the principles of the invention and is not intended to limit the spirit and scope of the invention and/or claims of the embodiment illustrated.

Shown in FIG. 1 is typical nursery 10 environment as known in hospitals or day care centers in which infants 20 are placed in cribs 22. The infants 20 are tended to by nurses or care givers 70. An important part of the present invention is the placement of a fixed or variable frequency resonant type sensor or tuned coil assembly 50 contained within a nondescript or innocuously colored packet 25 which is adhesively affixed to the infant's 20 diaper 30. Sensor monitoring and/or detecting equipment 35 is positioned at an ingress or egress 40 of the nursery 10 just outside but some distance away from the infant's 20 cribs 22 in a nursery area. There may be one or more monitor detecting equipment at a particular ingress or egress.

Positioned on the detector monitor 35 are indicators which may be a visual alarm such as a conventional colored light 37 and/or an audible alarm indicator 39 which may be a conventional buzzer, siren or other noise emitting device. An annunciator system panel 36 may be located near the ingress/egress 40 or remotely at a security office or nurses station (not shown) to indicate which ingress or egress 40 of the nursery 10 or other area has detected a sensor 50 as affixed onto an infant's 20 diaper 30. Detector monitor 35 is conventional and available by many different companies such as Model No. KE1 of the Keytec, Inc. of Berlin, N.J. Such passive sensors are common and well known in the art and utilize techniques using radiated electromagnetic energy from a monitor or detector station which is absorbed or "recognized" by the sensor and thereby becoming "active" which is then able to be detected by the monitor detection equipment 40 and indicated by alarm indicator mechanism such as light 37 or buzzer 39. The monitor indicator or detection equipment may be configured and varied as per the desired use. For example, silent remote alarm indication to a security office, nurses station or police station, with any number of combinations of audible and visual alarm indicators may be utilized. The detection circuitry may be configured to activate the alarm by either the sheer proximity or presence of the sensor 25 to the detector 35 or to specifically how close or how far the sensor has moved in relation to the detector 35 or the existence or absence of a sensor to the detector 35 in a specific area. Additionally, the sensors 25 may be of different resonant frequencies thereby allowing each infant to be assigned a specific frequency and the detector 35 can monitor the location of each infant 25 in the nursery 10, or elsewhere in a hospital or building, or in the event the infant is abducted, that the infant and abductor has passed through an egress 40.

Figure 2:
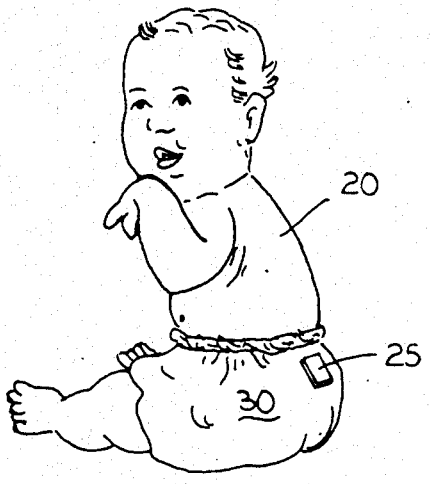
FIG. 2 is a perspective view of an infant depicted with the sensor of the present invention.

Turning now to FIG. 2, an infant 20 is shown with a conventional diaper 30, of either the disposable or washable reusable type to which a packet 25 or adhesive backed 28 type can be affixed to the diaper 30 so as to not conflict or restrict the movement of the infant nor cause any potential harm to the infant's health yet be positioned so as to be innocuously placed on the diaper so as to not alert a would be abductor to the sensor's presence and defeat the system's security purposes. It is not required, but recommended that the packet be placed on the backside of the diaper, as it is most common for infants to lay on their backsides thereby lessening the chance an abductor would notice said packet. However, if the infant were to lay on their stomach or front side, the use of the same or similar materials as the diaper would obscure its presence.

Figure 3:
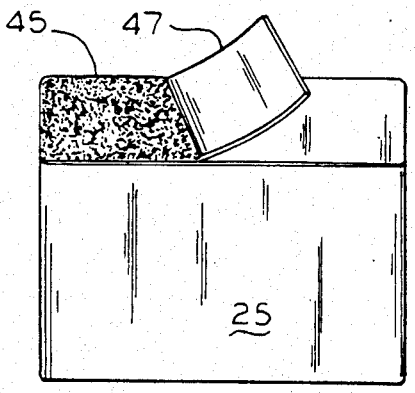
FIG. 3 is a top plan view of the packet of the present invention.

FIG. 3 shows the packet 25 with portions of the adhesive backing 47 removed exposing adhesive 25 for affixing to an infant's diaper 30 as shown in FIG. 2. Packet 25 may be configured to have an access on the side opposite the adhesive side 45 in which to place the sensor.

Figure 4:
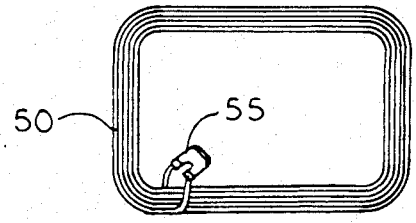
FIG. 4 is a plan view of the sensor assembly in one of the embodiments of the present invention.

Shown in FIG. 4 is a resonant frequency tuned coil sensor 50 to which a capacitor 55 is in electrical communication therewith creating, when energized by an electromagnetic field, a specific tuned frequency. The specific frequency is unimportant so long as it matches in frequency to the detection monitoring equipment and it does not interfere with other frequency related signals or is interfered with by other electromagnetic radiating devices and thereby outputting a false signal and alarm. For example, sensor 50 may be fixed to a tuned frequency of 8.2 Mhz and capacitor 55 may be of 33 pf value. These tuned coil sensors are available commercially from many sources one of which is Model No. LB10 of Multitag, Inc. of Boca Raton, Fla.

Figure 5:
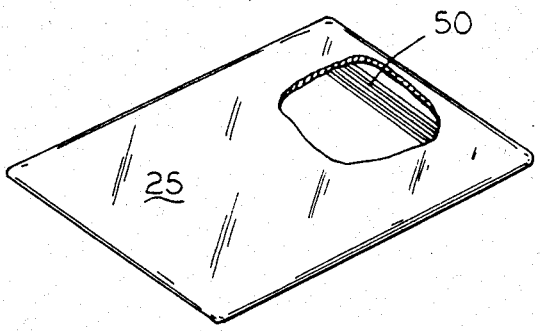
FIG. 5 is a perspective view with partial cutaway view of the sensor assembly and packet of the present invention.

Shown in FIG. 5 is the packet 25 with the tuned coil sensor 50 shown in partial cutaway as positioned inside the packet 25.

Figure 6:
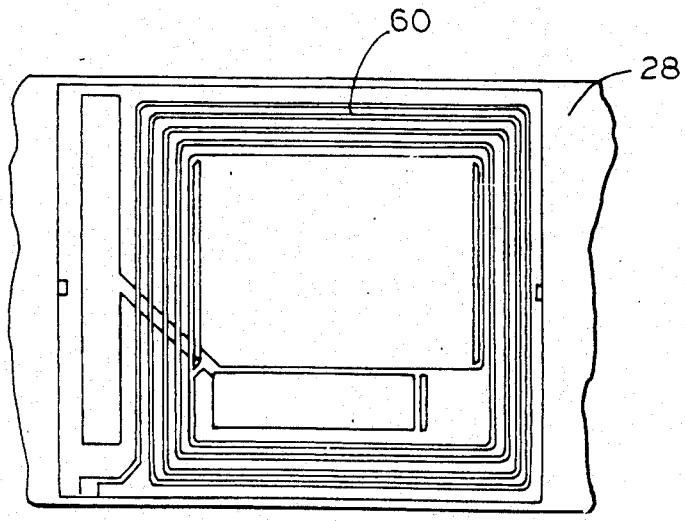
FIG. 6 is plan view of the sensor assembly of preferred embodiment of the present invention.

In FIG. 6, a cutaway view of the preferred embodiment of a tuned coil sensor 60 shown as a flat resistive-conductive paper type coil are also manufactured by Multitag, Inc. of Boca Raton, Fla. This type of sensor 60 may be utililzed in a similar adhesive packet 25 as shown in FIG. 5 or may be positioned on an adhesive paper backing 28 which is of the same color, texture and appears as the conventional disposable diapers in common use today. Additionally, sensor 60 may be coated with an adhesive and upon the removal of a protective backing is ready for application.

It should be noted that the sensors 50, 60 or packets 25 as shown on infant diapers in FIGS. 1 and 2 are depicted as being visible, when in physical actuality they would be hardly noticeable on an actual diaper.

The operation of the present invention is simply and effectively described as follows. Referring to the Figures in general, a tuned resonant circuit sensor either of the type 50 or 60 shown, is placed into an adhesive backed packet 25 or by its own adhesive backing 28 whereupon the adhesive protective backing 47 is removed exposing adhesive 45 and is placed on the diaper 30 of an infant 20. The infant is then placed into a crib 22 or a playpen etc. in the typical hospital nursery 10 or day care type of environment. General care can be provided to the infant 20 by a nurse or care giver 70 which includes feeding, examinations by physicians or cuddling by proud parents without interference or probably even awareness of sensors 50 or 60 on the infant's 20 diaper. When a diaper 30 affixed with a sensor 50, 60 is soiled, it may, if desired be removed from a washable diaper 30 and disposed of before the washing of the diaper 30 or if on a disposable diaper 30, the sensor 50, 60 may simply be discarded with the diaper 30. Whereupon, if an infant 20 wearing a diaper affixed with the sensor 50, 60 is kidnapped or passed through and egress 40 or even another ingress 40 to another unpermitted room, detector monitor 35 will alert either or both alarm system indicators 37 or 39 positioned onto monitor detectors 35. An annunciator panel 36 may be used to specifically identify which ingresses or egresses 40 or even specific sensors 50, 60 if the sensors are individually tuned. Such detection thereby alerts a care giver 70 to notify security and to pursue the abductor. The system can be manually or automatically reset as desired and configured by the monitor detection circuitry.

It is further intended that the system may equally be applicable to adults whereby sensors 50, 60 may be utilized on adults to monitor location or presence in an non-intrusive manner by being affixed to clothing, shoes and other wearing apparel as shown with an infant in FIG. 2. The use of such non-intrusive sensors for the elderly allows them to retain their dignity while still being monitored by nursing home personnel.

The foregoing specification describes only the preferred embodiment of the invention as shown. Other embodiments besides the ones shown and described may be articulated as well. The terms and expressions therefore serve only to describe the invention by example only and not to limit the invention. It is expected that others will perceive differences which while differing from the foregoing, do not depart from the spirit and scope of the invention herein described and claimed.

What I claim is:

1. A surreptitious security system for infants comprising:

tuned coil means inconspicuously affixed to the diaper of an infant;

detector means for detecting when said tuned coil means affixed to the infant is in physical proximity to said detector means; and alarm means for indicating when said detector means has detected said tuned coil means.

2. The invention claimed in claim 1, wherein said tuned coil means is affixed to the infant's diaper.

3. The invention claimed in claim 2, wherein said tuned coil means affixed to the infant's diaper is disposable.

4. The invention claimed in claim 2, wherein said tuned coil means is adhesively affixed to the infant's diaper in an inconspicuous manner.

5. The invention claimed in claim 1, wherein said security system is used in a hosptial.

6. The invention claimed in claim 5, wherein said detector means is positioned at entrances and exits of the hospital.

7. The invention claimed in claim 1, wherein said alarm means emits an audible sound.

8. The invention claimed in claim 1, wherein said alarm means is a visual indicator.

9. A surreptitious security system for infants comprising:

sensor means affixed to the garment of an infant;

detector means for detecting when said sensor means is not in physical proximity to said detector means; and alarm means for indicating when said detector means has detected when said sensor means is not in physical proximity to said detector means.

10. The invention claimed in claim 9, wherein the sensor means is affixed to the infant's diaper.

11. The invention claimed in claim 10, wherein said sensor means affixed to the infant's diaper is disposable.

12. The invention claimed in claim 10, wherein said sensor means is adhesively affixed to the infant's diaper.

13. The invention claimed in claim 12, wherein said sensor means is adhesively affixed to the infant's diaper in an inconspicuous manner.

14. The invention claimed in claim 9, wherein the security system is used in a hospital.

15. The invention claimed in claim 14, wherein said detector means is positioned at points of ingress and egress of the hospital.

16. The invention claimed in claim 9, wherein said alarm means emits an audible sound.

17. The invention claimed in claim 9, wherein said alarm means is a visual indicator.

18. A surreptitious security system for humans wearing clothing for use in a building, comprising:

a sensor means in a packet affixed to the clothing of a human, said packet positioned to the clothing in an inconspicuous location;

detector means for detecting the proximity to said sensor means affixed to the clothing of humans; and alarm means in communication to said detector means indicating that the sensor means in said packet affixed to the humans is in proximity to said detector means.

19. A surreptitious security system for humans wearing clothing for use in a building, comprising:

sensor means in a packet affixed to the clothing of a human, said packet positioned to the clothing in an inconspicuous location;

detector means for detecting the proximity to said sensor means affixed to the clothing of the human; and alarm means in communication to said detector means indicating that the sensor means in said packet affixed to the human is in proximity to said detector means.

20. An apparatus for detecting the movement of an infant within a predetermined area using a sensing system that causes an alarm, comprising:

detectable means inconspicuously affixed to the diaper of an infant for triggering the sensing system and causing the alarm when the detectable means enters the predetermined area.

21. An apparatus for detecting the movement of an infant within a predetermined area using a sensing system that causes an alarm, comprising:

detectable means inconspicuously affixed to the diaper of an infant for triggering the sensing system and causing the alarm when the detectable means leaves the predetermined area.

* * * * *